US006089000A

United States Patent [19]

Carlberg et al.

[11] Patent Number: 6,089,000

[45] Date of Patent: Jul. 18, 2000

[54] PROGRAMMABLE DEVICE PACKAGING METHOD AND SYSTEM

[75] Inventors: David L. Carlberg; Theodore V. Meigs, both of Twain Harte, Calif.

[73] Assignee: Kinematic Automation, Inc., Twain Harte, Calif.

[21] Appl. No.: 09/166,333

[22] Filed: Oct. 5, 1998

[51] Int. Cl.[7] ..... B65B 35/30

[52] U.S. Cl. ..... 53/443; 53/148; 53/542

[58] Field of Search ..... 53/147, 148, 443, 53/444, 448, 542, 532, 533

[56] References Cited

U.S. PATENT DOCUMENTS

| | | | |
|---|---|---|---|
| 3,435,584 | 4/1969 | Prechter | 53/542 X |
| 3,648,431 | 3/1972 | Hartbauer et al. | 53/542 X |
| 4,098,392 | 7/1978 | Greene | 53/532 X |
| 4,386,490 | 6/1983 | Griffith et al. | 53/148 |
| 4,453,368 | 6/1984 | Egee | 53/148 X |
| 4,531,343 | 7/1985 | Wood | 53/542 X |
| 4,611,705 | 9/1986 | Fluck | 53/542 X |
| 4,641,489 | 2/1987 | Wood | 53/542 X |
| 4,748,798 | 6/1988 | Udaka et al. | 53/532 X |
| 4,828,101 | 5/1989 | Fluck | 53/542 X |
| 4,870,803 | 10/1989 | Blumle | 53/448 X |
| 4,965,983 | 10/1990 | Muller et al. | 53/520 X |
| 5,067,309 | 11/1991 | Carlberg et al. | 53/520 |
| 5,175,980 | 1/1993 | Chiappe et al. | 53/532 X |
| 5,471,822 | 12/1995 | Dugan et al. | 53/532 |
| 5,636,494 | 6/1997 | Black | 53/542 X |
| 5,816,030 | 10/1998 | Carlberg et al. | 53/520 |

*Primary Examiner*—Daniel B. Moon
*Attorney, Agent, or Firm*—Harris Zimmerman

[57] ABSTRACT

A packaging method and apparatus for packing items in selectively variable numerical quantities includes a track assembly adapted to support a plurality of strip items in parallel array. In a first section of the track assembly, a lateral slot receives consecutive batches of strips in parallel array. A plurality of pusher elements extend through a track slot, pushing the strips to impinge on each other in edge-adjacent fashion, and to translate distally from the first stage. A second stage of the track assembly includes a sufficient length of the track to accumulate a large number of strips. At the distal end of the track, a strip collection cylinder receives the strips. One end of the cylinder is configured to receive the open end of a bottle package, and the other receives a plunger to push the accumulated strips from to the bottle. A pusher element mechanism is programmable to extend into the track slot at any selected distance from the collection cylinder, and to push into the collection cylinder all the strips between that point and the cylinder. Given the uniform size of the strips and their edge-adjacent impingement, the pusher element easily may be directed to select any number of strips to be pushed into the collection cylinder. Thus, each container may be filled with any selected number of strips, that number ranging from far less to many more than the quantity of each batch that is fed into the proximal end of the track assembly.

2 Claims, 5 Drawing Sheets

PROGRAMMABLE DEVICE PACKAGING METHOD AND SYSTEM

BACKGROUND OF THE INVENTION

This invention relates to packaging systems for devices and objects, and, more particularly, to systems for packaging such items in selectively variable quantities. There are many different types of products that are packaged in plastic or metal bottles or vials. One such product that comprises a very large commercial activity is diagnostic test strips used for medical, chemical, and biological tests and assays.

Many medical, chemical and biological diagnostic tests and assays for laboratory and home use have been reduced to an optimally simple routine: immerse a test strip or stick into a liquid, and observe the change in color of the test strip or stick to read the results of the test. Tests that formerly required days of laboratory work may now be carried out in seconds, with a reliability factor that exceeds former, more time-consuming methods. Generally speaking, the strips or sticks (hereinafter, "strips") comprise long, narrow pieces of paper, plastic, or similar sheet material that carry carefully formulated combinations of highly specific reagents, reactants, or assay compounds.

The sheet material may be manufactured in large amounts, generally as long webs of the sheet material wound on spools to form a compact roll. Typically, the web material is first fed from the roll into a cutter that forms smaller, uniform cards, and each card is then fed through the cutter assembly. The cards are fabricated into the test strips using a strip cutter assembly, which comprises two cutter spindle assemblies, each having a plurality of cutting disks secured in longitudinally spaced relationship. The disks of the adjacent cutter assemblies are disposed in paired relationship, each pair being closely adjacent with overlapping peripheral edges. The cutter assemblies are driven to rotate, so that cards passing therethrough are severed into a large plurality of strips in one operation. A necessary outcome of this process is that the test strips are formed in discrete groups or batches, all having the same number of strips. As a rule, the subsequent automated packaging machinery is optimized to handle the strips in these groups, so that each package contains a number of strips equal to the number of strips in each group emanating from the strip cutter assembly.

However, the demands of the marketplace require that many products be packaged in quantities that differ from the number determined by the strip cutter assembly, or any similar manufacturing process that produces items in groups that are numerically identical For example, packages of small numbers of items may be required for samples, or trial offers, while several different packaging quantities may be needed by the end consumer, depending on the use patterns, pricing policies, and the like.

For manufacturing efficiency, it is advantageous to produce a product on one system, and not be required to provide several systems because of differing packaging needs. Therefore, a system that can manufacture and package a product in a variety of quantity configurations can offer many advantages to the manufacturer; e.g., lower capital cost, smaller manufacturing space requirements, lower labor costs, higher quality, and faster response to changing market demands. The state of the art is deficient in such flexible manufacturing and packaging systems.

SUMMARY OF THE INVENTION

The present invention comprises a programmable packaging method and system for grouping and packing items in selectively variable numerical quantities.

In one aspect, the method of the invention includes a first stage of receiving items in groups or batches of identical number from a production machine. Thereafter, in a second stage the items are accumulated in a quantity greater than the size of the groups feeding the first stage. In a third stage, the items are delivered from the system to a packaging device in quantities that are selectively programmed, whereby packages of any desired numerical quantity may be created, without regard or limitation of the initial quantities in the batches feeding the first stage.

In a further aspect, invention includes a system for packaging items such as diagnostic strips in packages of selectively variable quantities. The system includes a track assembly adapted to support a plurality of strips in parallel array, The track assembly extends longitudinally, and includes laterally opposed flanges that engage the ends of the strips, whereby the strips may be translated only in the longitudinal direction. The track assembly includes a slot extending longitudinally. A plurality of pusher elements extend from a linear actuator adjacent to the track assembly, and are disposed to extend through the track slot. The pusher elements may be extended into the track slot, translated therealong, and then retracted from the track slot.

In a first section of the track assembly, a lateral inlet in one of the flanges is provided to receive groups or batches of strips in parallel array. The strips are oriented to feed into the inlet along their longitudinal axes, so that the strips extend laterally between the flanges of the track assembly and are secured therein. After each group or batch of strips is received, a pusher element translates longitudinally and distally in the track slot. The pusher element engages the most proximal strip, pushing the strips to impinge on each other in edge-adjacent fashion, and to translate the batch distally from the first stage. A second stage of the track assembly includes a sufficient length of the track so that a plurality of batches are accumulated as they translate along the track.

In a third section of the track assembly, the distal end of the track is connected to a strip collection cylinder. The cylinder includes a tangential opening leading to the distal end of the track to permit the input of strips to the cylinder. One end of the cylinder is configured to receive the open end of a bottle or vial package. At the other end of the cylinder, a plunger is disposed to translate reciprocally, so that strips accumulated in the cylinder may be driven longitudinally into the bottle or vial.

A significant feature of the assembly is the provision of at least one pusher element to push the strips into the collection cylinder. The pusher element mechanism translates the pusher element both longitudinally along the track slot as well as into and out of the track slot. The mechanism is programmable to extend into the track slot at a point at any selected distance from the collection cylinder, and to push into the collection cylinder all the strips between that point and the cylinder. Given the uniform size of the strips and their edge-adjacent impingement, the pusher element easily may be directed to select any number of strips to be pushed into the collection cylinder. Thus, each container brought into registration with the collection cylinder may be filled with any selected number of strips, that number ranging from far less to many more than the quantity of each batch that is fed into the proximal end of the track assembly. The only limitation is that the number of strips accumulated in the second section of the track assembly must exceed the number of strips that are pushed into the collection cylinder.

DESCRIPTION OF THE PREFERRED EMBODIMENT

Figure 1:
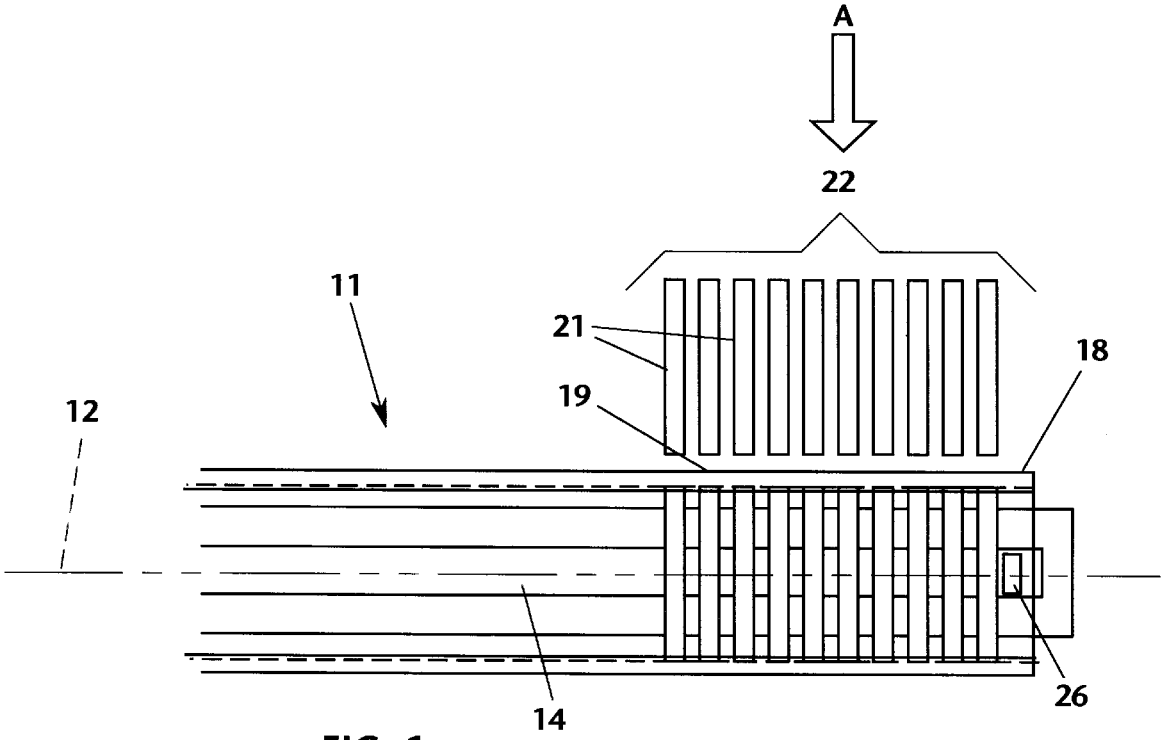
FIG. 1 is a diagrammatic plan view of the first stage of the programmable device packaging system of the invention.
Figure 2:
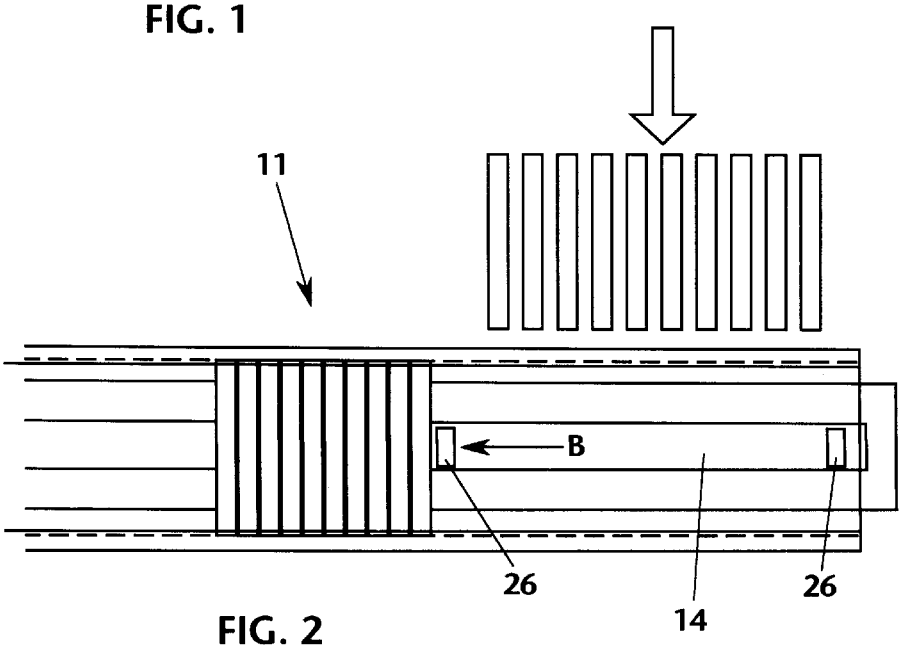
FIG. 2 is a diagrammatic plan view of the first stage of the programmable device packaging system, sequential to FIG. 1.

The present invention comprises a programmable packaging method and system for grouping and packing items in selectively variable numerical quantities. With regard to FIGS. 1–5, the system of the invention includes a track assembly 11 extending along a longitudinal axis 12. The track assembly includes a shallow longitudinal channel 13, and a slot 14 that extends through the bottom of the channel 13 coaxially with the longitudinal axis 12. The laterally opposed sides 16 of the channel 13 are provided with grooves 17 extending laterally therein and running the length of the channel 13. At a proximal end 18 of the track assembly 11, a lateral slot 19 extends through one of the sides 16.

The track assembly 11 is dimensioned to accommodate a large number of uniformly dimensioned strips 21, which are provided in groups or batches 22 from a strip cutter mechanism. Each strip 21 has a length dimension that is slightly greater than the spacing of the sides 16 of the channel 13, the strip length dimension spanning the lateral distance between the grooves 17 with minimal clearance for free translation therealong. Thus the strips 21 are entrained within the grooves 17 and are slidably translatable along the longitudinal axis of the track assembly. Each batch 22 comprises the same number of strips 21 disposed in parallel array, the strips in each batch being spaced apart in a direction parallel to the longitudinal axis 12. The lateral slot 19 is provided with a height and longitudinal extent sufficient to receive therethrough a batch 22 of strips 21. Thus an entire batch 22 may be loaded through slot 19 into the track assembly 11, whereafter the strips of the batch are engaged at their respective ends in the grooves 17 and are constrained to move only longitudinally in the track assembly.

The track assembly 11 further includes a plurality of pusher elements 26 dimensioned to extend through the slot 14 in freely translating fashion. Each pusher element 26 is controlled by a mechanism that provides linear translation of the pusher element as well as vertical translation thereof, whereby each pusher element may be extended into and through the slot 14, translated longitudinally and distally in the slot, and then withdrawn vertically from the slot. Such mechanism may include a linear actuator, rack and pinion drive, motor drive, pulley or belt system, or any other mechanical expedient known in the prior art.

Initially, a batch 22 of strips 21 are slidably loaded through slot 19 into the track assembly 11, as shown by arrow A in FIG. 1. A pusher element 26 is disposed in the slot 14 proximally of the batch 22, and is translated distally in the slot 14 to engage the batch 22, as shown by arrow B in FIG. 2. The pusher element engages the most proximal strip of the batch 22, causing the strips to be urged into abutting impingement and eliminating the longitudinal spacing therebetween, The batch 22 is then translated as a condensed group distally along the track assembly 11. The engagement of the ends of the strips remain engaged in the grooves 17, and there is insufficient clearance for the strips to ride up over each other, or to rotate in the plane of the track assembly. Thus the strips remain in a parallel array and in abutting impingement as they translate distally.

Figure 3:
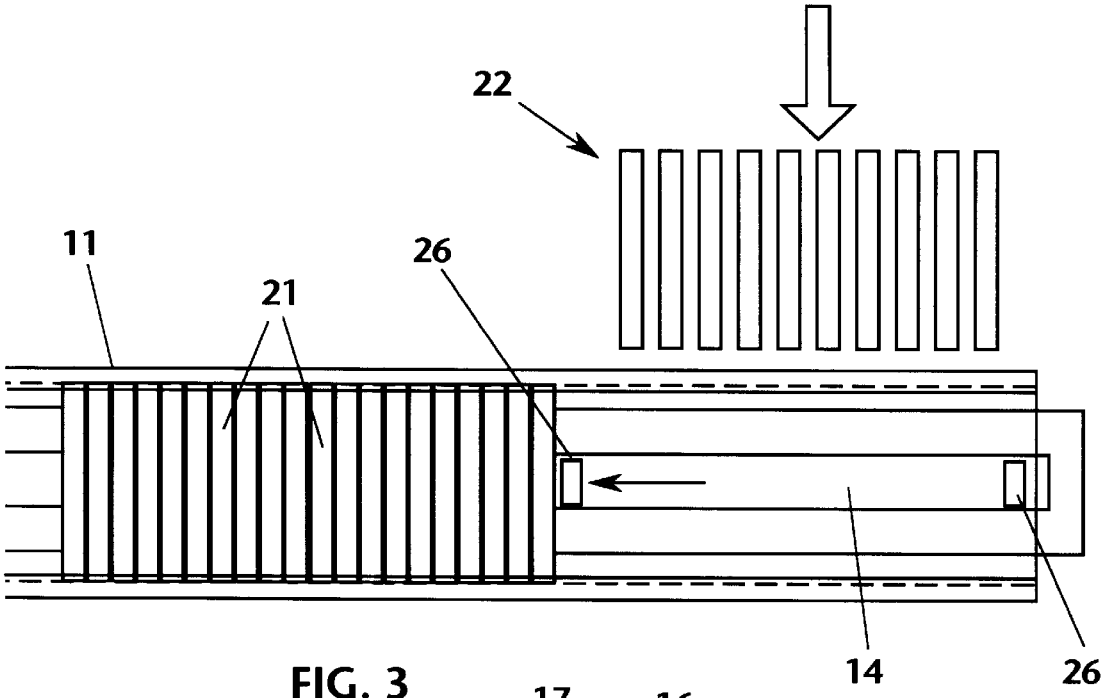
FIG. 3 is a diagrammatic plan view of the first stage of the programmable device packaging system, sequential to FIG. 2.
Figure 4:
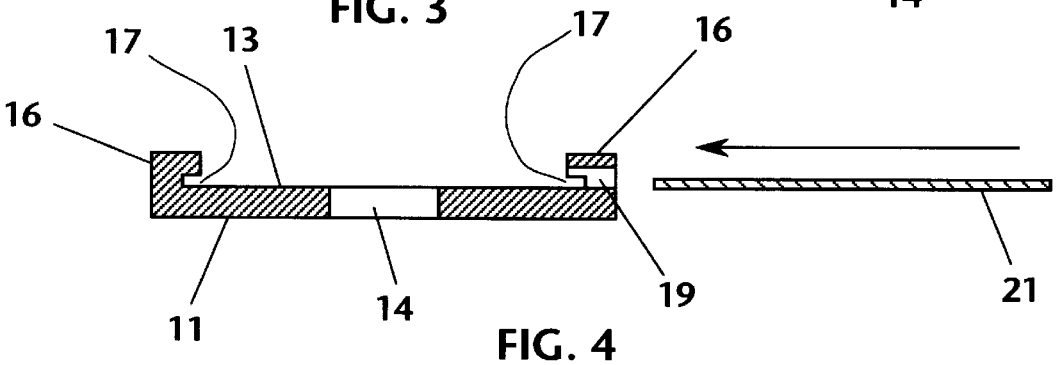
FIG. 4 is a cross-sectional end elevation of the first stage of the programmable device packaging system, taken along line 4—4 of FIG. 1.
Figure 5:
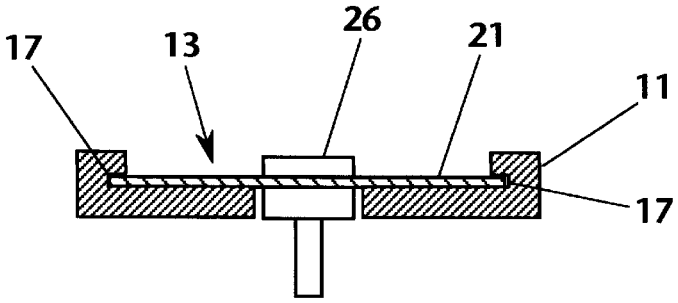
FIG. 5 is a cross-sectional end elevation of the first stage of the programmable device packaging system, taken along line 5—5 of FIG. 1.

As each batch 22 is urged distally of the input slot 19, a further batch 22 is provided in lateral alignment with the slot 19 and inserted therethrough and loaded into the track assembly. Another pusher element 26 then extends into the slot 14 proximal to the further batch and translates that batch distally along the track assembly, as shown in FIG. 3, while the first mentioned pusher element 26 is withdrawn from the slot 14. In this manner a large number of strips 21 may be accumulated in abutting impingement in the longitudinal extent of the track assembly 11 distal of the intake slot 19. Thus the me dial portion of the track assembly comprises a facility for accumulating a large quantity of strips 21 in preparation for the packaging step.

Although each batch 22 is depicted as comprising 10 strips, it may be appreciated that the strip cutter assembly that generates each batch may provide any fixed number of strips. However, it may be required that the strips must be packaged in numerical quantities that do not equal the numerical quantity of strips in each batch 22. For example, the packaging operation may require varying numbers of strips in each package, or the package quantity may be constant but dissimilar to the batch quantity.

Figure 6:
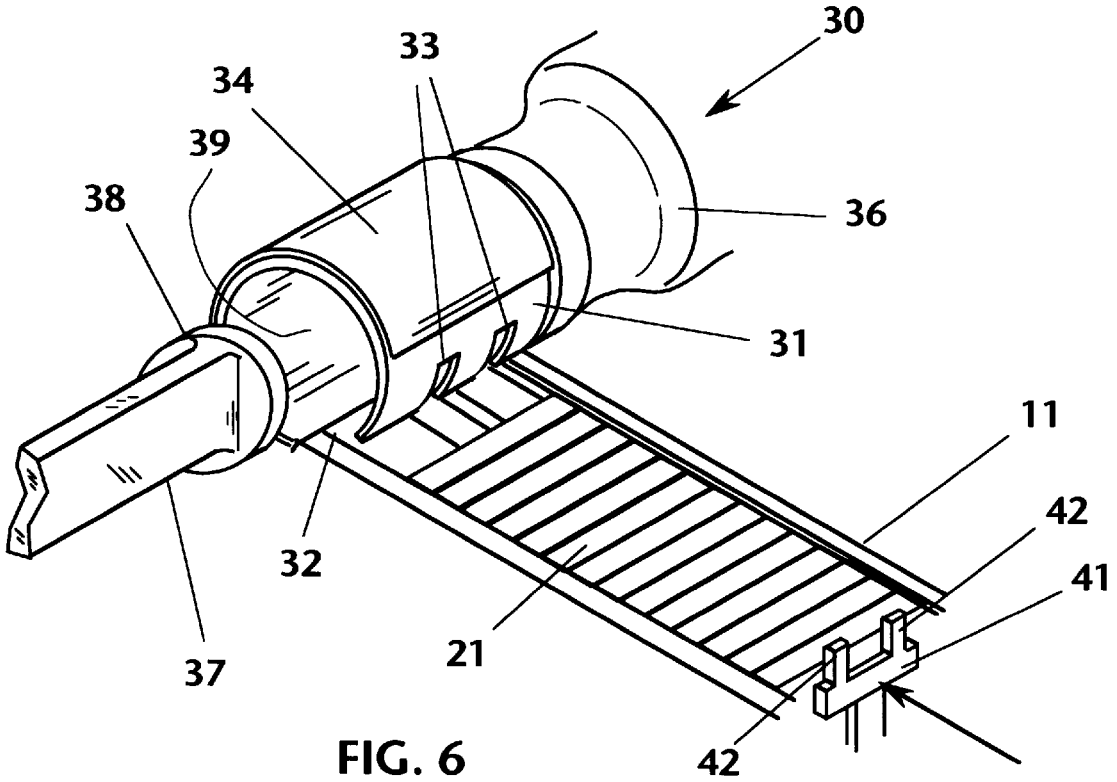
FIG. 6 is a perspective view of the third stage of the programmable device packaging system, showing a plurality of strips accumulated in the track assembly.

With regard to FIG. 6, the distal end of the track assembly 11 is joined to a strip collection assembly 30. The strip collection assembly includes a collection cylinder 31 having an axis disposed transverse to the longitudinal axis 12 of the track assembly and parallel to the lengths of the strips 21 in the track assembly. The cylinder 31 is tubular, and one open end is disposed to receive the open end of a bottle or vial package 36. The cylinder 31 includes a longitudinal slot 32 extending the length thereof and disposed to engage the distal end of the track assembly in tangential relationship. A pair of notches 33 extend chordally from the slot 32 and are spaced along the length of the collection cylinder 31. A gate 34, comprising a cylindrical panel section concentric to the collection cylinder 31, is adapted to be rotated from a non-engaged, open position (as in FIG. 6) to a closed position (FIG. 8) in which the slot 32 and notches 33 are blocked. The collection cylinder 31 includes an open end 39, and a plunger 37 is disposed adjacent to the open end 39 and aligned with the axis of the collection cylinder. The plunger 37 includes a disc end 38 having a diameter substantially similar to the diameter of the collection cylinder, and the plunger is adapted to translate linearly and reciprocally into the collection cylinder.

The distal end of the track assembly further includes a pusher element 41 that is extendable through the track slot 14 in a manner similar to the pusher element 26 described previously. That is, the pusher element 41 is controlled by a mechanism that includes a horizontal actuator 43 to provide longitudinal linear translation of the pusher element, as well as a vertical actuator 44 to provide vertical translation thereof, whereby each pusher element may be extended into and through the slot 14, translated longitudinally and distally in the slot, and then withdrawn vertically from the slot, as depicted in FIG. 10.

The actuators 43 and 44 are operated selectively to retract the pusher element 41 from the slot 14, and translate the pusher element proximally to a selected distance from the collection cylinder 31. Given the fact that the strips 21 are accumulated in the track assembly in abutting impingement, and that the strips are uniform in width and length dimensions, the distance of movement proximally corresponds precisely with the number of strips disposed between any point on the track assembly and the collection cylinder. Thus the proximal translation distance is used to select the number of strips that are to be advanced to the collection cylinder. Sensors such as photoelectric detectors or the like may be provided to verify the number of strips stored along any given length of the track assembly extending proximally from the collection cylinder. At the selected point corresponding to the desired quantity, the pusher element is translated vertically through the track slot 14. The pusher element is provided with a pair of tines 42 extending upwardly therefrom to minimize the disturbance caused by the pusher element 41 protruding between the strips. The tines move up under one strip, lifting and bending it slightly. As the pusher element is translated toward the collection cylinder 32, it leaves the lifted strip behind and moves all the strips that are downstream toward the collection cylinder. The tines 42 are dimensioned to pass through the slots 33 and into the collection cylinder 32.

Figure 7:
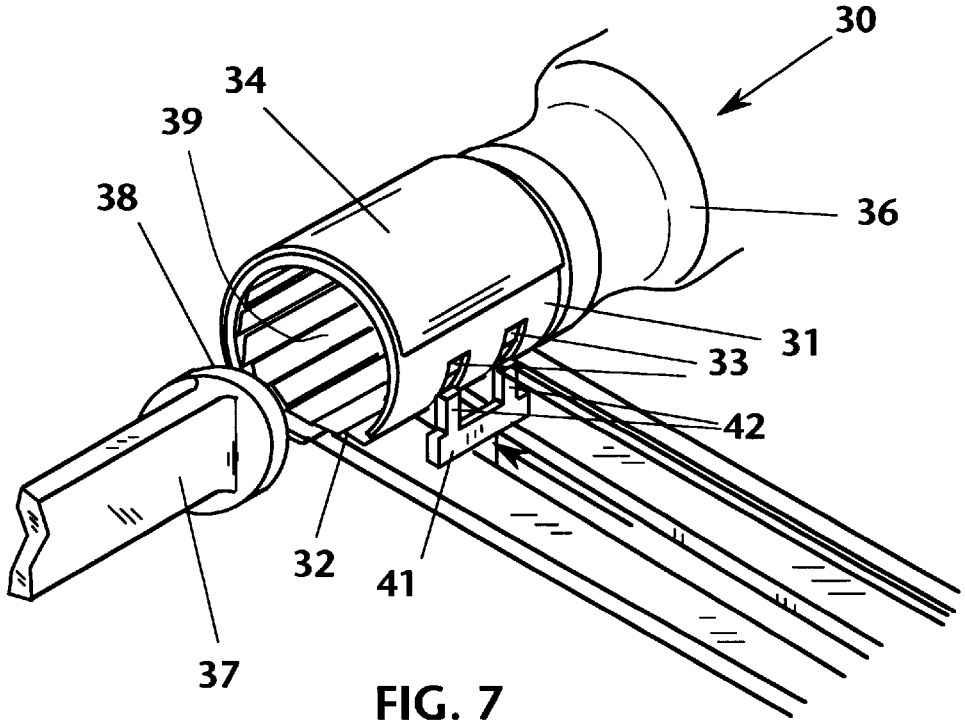
FIG. 7 is a perspective view of the third stage of the programmable device packaging system, showing a plurality of strips pushed into the collection cylinder assembly.
Figure 8:
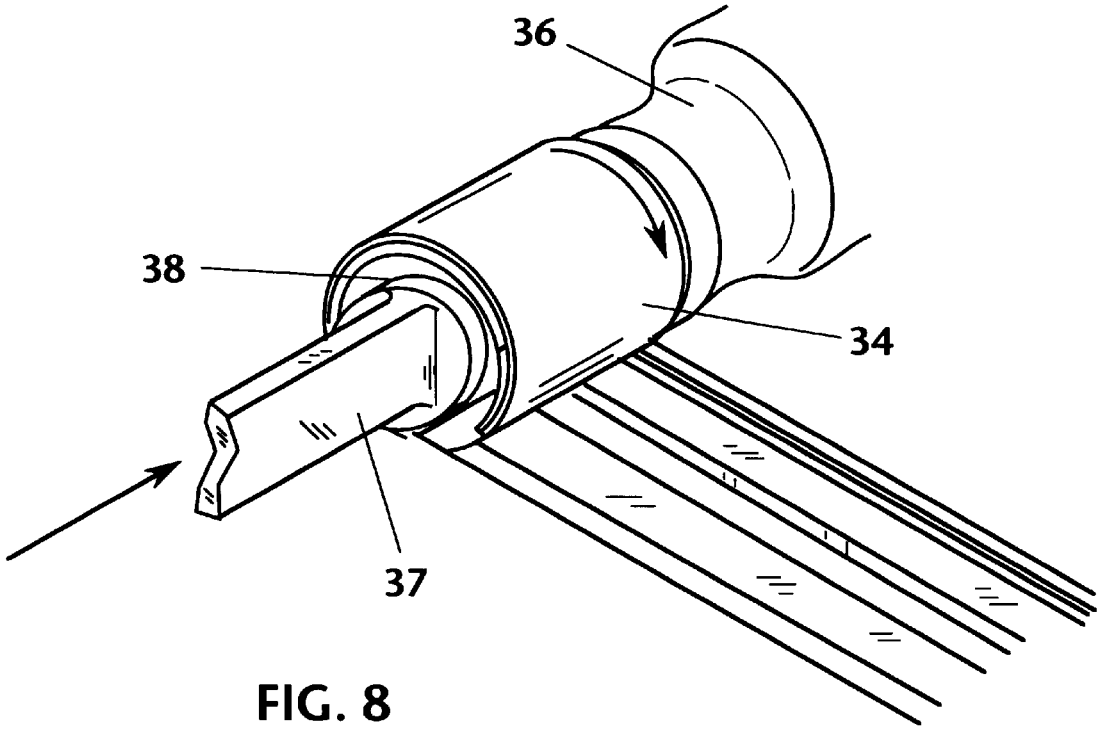
FIG. 8 is a perspective view of the third stage of the programmable device packaging system, showing a plurality of strips being pushed from the collection cylinder into a packaging bottle.

The pusher element 41 is then translated distally, so that the selected number of strips 21 is then urged distally along the track assembly, through the slot 32 and into the collection cylinder 31, as shown in FIG. 7. The pusher element 41 is then withdrawn from the track slot. Thereafter, the gate 34 is rotated to the closed position, as shown in FIG. 8, securing the strips in the collection cylinder, and the plunger 37 is advanced into the open end 39 to urge the collected strips into the package 36. The plunger is retracted reciprocally, the gate 34 is rotated to the open position, and the process may then be reiterated with a fresh package 36 brought into registration with the collection cylinder. It may be appreciated that in each packaging cycle, the number of strips advanced into the collection cylinder may be selectively varied, or may be constant, depending on the need, package size, and other factors. Thus the packaging quantity is individually programmable for each package, and is independent of the number of strips delivered in each batch 22.

Figure 9:
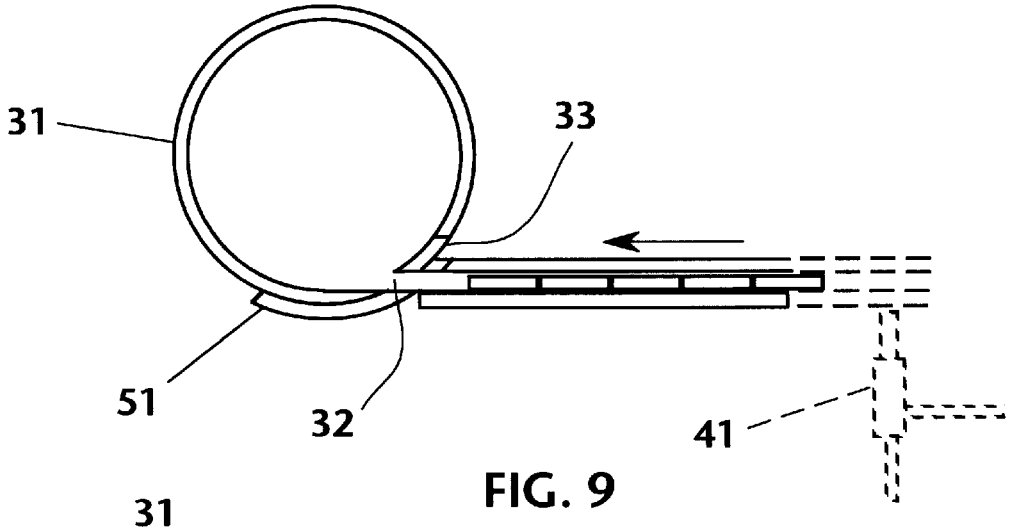
FIG. 9 is a side elevation of another embodiment of the collection cylinder portion of the programmable device packaging system.
Figure 10:
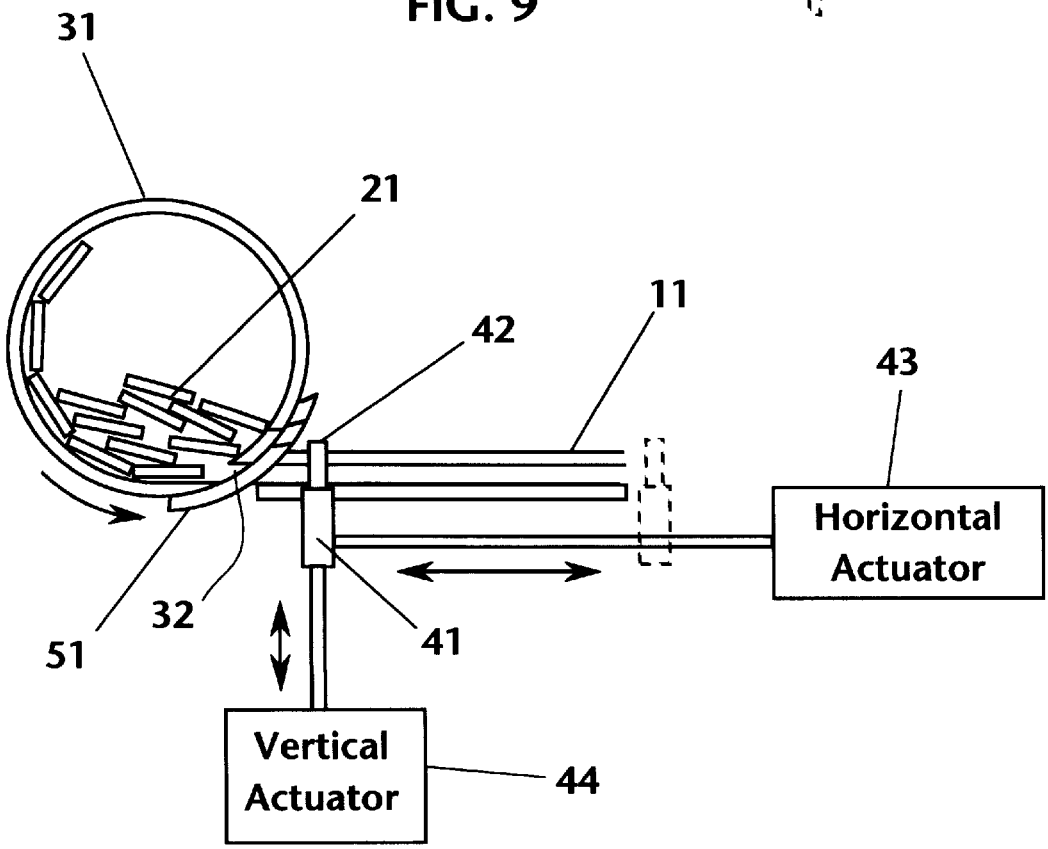
FIG. 10 is a side elevation of the collection cylinder as in FIG. 9, showing the pusher assembly loading a plurality of strips into the collection cylinder.

In a further embodiment of the invention, shown in FIGS. 9 and 10, components similar to the previous embodiment are labeled with the same reference numerals. The collection cylinder 31 is configured as described above, but the gate 34 is omitted. Rather, there is provided a gate 51, comprising a cylindrical panel section concentric to the collection cylinder 31 and extending generally adjacent to the slot 32 of the collection cylinder. The gate 51 is adapted to be rotated from an open position below the cylinder 31 and adjacent to the slot 32, as shown in FIG. 9, to a closed position (FIG. 10), in which the slot 32 is occluded. If the notches 33 are not overly large, it may not be necessary to block the notches 33. Accordingly, the gate 51 need not extend to cover the notches 33 in order for the plunger 37 to push the collected strips into the packaging container 36.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A method for packing items in selectively variable numerical quantities, including the steps of:

providing a track assembly adapted to receive the items and translate therealong;

loading a plurality of batches of the items into one end of the track assembly;

translating the items to a medial portion of the track assembly and accumulating a large plurality of the items in the medial portion of the track assembly;

providing a packaging assembly at the other end of the track assembly;

delivering selectively variable quantities of the items from the medial portion of the track assembly to the packaging assembly;

said plurality of batches all containing the same quantity of the items;

said step of translating the items to a medial portion including providing a first pusher element to engage each batch that is loaded into said one end of the track assembly and urge said each batch toward said medial portion of the track assembly, thereafter disengaging said first pusher element from said each batch and moving said first pusher element retrograde to said one end of the track assembly, and reiterating the step of translating the items to a medial portion, whereby a plurality of the items are disposed in said medial portion of the track assembly in abutting, impinging, uniformly spaced relationship;

said step of delivering selectively variable quantities of the items including providing a second pusher element, moving said second pusher element proximally to a location at a selected distance from said other end of the track assembly, said selected distance corresponding to a desired quantity of the items stored in said track assembly between said location and said other end of the track assembly, and thereafter translating said second pusher element toward said other end to push said desired quantity of the items to said packaging assembly;

said step of providing a packaging assembly including providing a tubular packaging cylinder fixedly secured to said other end of said track assembly, said tubular packaging cylinder having one open end adapted to receive a packaging container and another open end adapted to receive a plunger, and reciprocally translating said plunger to urge items accumulated in said packaging cylinder into the packaging container;

further providing a slot opening in said tubular packaging cylinder extending tangentially and longitudinally therein, and placing said other end of the track assembly in registration with said opening to transfer the items through said slot opening into said tubular packaging cylinder.

2. An apparatus for packing items in selectively numerical quantities, including:

a track assembly extending longitudinally and including opposed sides having means for engaging opposed ends of the items to constrain all movement thereof except longitudinal translation;

said track assembly including a proximal end and distal end and a longitudinal axis extending therebetween, and lateral inlet slot means in said proximal end for receiving batches of the items, each batch comprising a fixed quantity of the items disposed in parallel, longitudinally spaced apart array;

said track assembly including a longitudinally extending slot, and first pusher means for translating in said slot and urging each batch distally and also moving the items into abutting impingement with no longitudinal spacing therebetween, said items accumulating in large quantity distally from said proximal end of the track assembly;

said first pusher means including first pusher elements adapted to extend into said slot and translate longitudinally therealong and retract from said slot in a reiterative manner a packaging assembly fixedly secured at said distal end of the track assembly;

second pusher means for translating in said slot to a location at a selected variable distance from said distal end of the track assembly, said selected variable distance corresponding to a desired quantity of the items stored in said track assembly between said location and said distal end of the track assembly, and thereafter translating toward said distal end to push said desired quantity of the items into said packaging assembly;

said second pusher means including second pusher elements, means for extending said second pusher elements reciprocally into said slot, and means for moving said second pusher elements distally in said slot;

said packaging assembly including a tubular cylinder having a cylinder axis extending transversely to said longitudinal axis, and a generally tangential opening extending in said tubular cylinder for connecting to said distal end of said track assembly and transferring therethrough said desired quantity of the items;

said tubular cylinder including one open end adapted to receive a packaging container and another open end adapted to receive plunger means for reciprocally translating to urge the items accumulated in said tubular cylinder into the packaging container; and, gate means for blocking said generally tangential opening in said tubular cylinder when said plunger means translates into said tubular cylinder.

* * * * *